US007299670B2

(12) United States Patent
Shohara et al.

(10) Patent No.: US 7,299,670 B2
(45) Date of Patent: Nov. 27, 2007

(54) METHOD AND APPARATUS FOR PRODUCING CYLINDRICAL COMPONENTS HAVING BENT PORTIONS

(75) Inventors: Hiroshi Shohara, Toyohashi (JP); Tatsuji Hayashi, Toyokawa (JP); Yuji Eguchi, Toyohashi (JP); Shigeo Hattori, Toyohashi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/349,183

(22) Filed: Feb. 8, 2006

(65) Prior Publication Data

US 2006/0185414 A1 Aug. 24, 2006

(30) Foreign Application Priority Data

Feb. 18, 2005 (JP) ..... 2005-042014

(51) Int. Cl.
*B21D 22/00* (2006.01)

(52) U.S. Cl. ..... 72/84; 72/82; 72/107

(58) Field of Classification Search ..... 72/82, 72/84, 110, 111, 124, 83, 102, 107
See application file for complete search history.

(56) References Cited

U.S. PATENT DOCUMENTS 3,654,790 A * 4/1972 Zatko ..... 72/82
3,831,414 A * 8/1974 Haswell et al. ..... 72/82
3,953,995 A * 5/1976 Haswell et al. ..... 72/84
4,144,732 A * 3/1979 Franks et al. ..... 72/84
4,455,853 A * 6/1984 Kanemitsu ..... 72/84
5,582,054 A 12/1996 Yoshino et al.
6,161,409 A * 12/2000 Friese ..... 72/110

FOREIGN PATENT DOCUMENTS

JP A 7-148536 6/1995

* cited by examiner

*Primary Examiner*—Ed Tolan
(74) *Attorney, Agent, or Firm*—Oliff & Berridge, PLC

(57) ABSTRACT

A preparatory molding roll 4 having a convex push surface 41 is pushed to an outer peripheral surface of a work 1A while the work 1A is chucked by a pair of molds 2 and 3 and is rotated by applying axial propelling force, to bend inward the outer peripheral surface of the work in a radial direction. The work is then chucked by the preparatory molding roll and the upper and lower molds. Next, the preparatory molding roll is moved back and the work is crushed in the axial direction to form a bent portion 1*a*. A molding roll 5 is pushed to mold the outer shape of the work. A grooved roll 6 is next pushed to the outer peripheral surface of the work and a groove 1*b* is formed on the outer peripheral surface.

9 Claims, 7 Drawing Sheets

METHOD AND APPARATUS FOR PRODUCING CYLINDRICAL COMPONENTS HAVING BENT PORTIONS

BACKGROUND OF THE INVENTION

1. Field of the Invention

This invention relates to a method, and an apparatus, for producing a cylindrical component having a bent portion, and is particularly suitable for producing a bearing sleeve of a resin pulley.

2. Description of the Related Art

To acquire driving force from an engine in a compressor used for a car air conditioner, a pulley B is fitted to a housing side of the compressor through a bearing A in such a manner as to be capable of rotating as shown in FIG. 1. On the other hand, a hub C is fixed to a rotary shaft of the compressor and a power transmission system is formed between the pulley B and the hub C. A belt is wound on an outer peripheral surface of the pulley B. The pulley B is rotated by power from outside such as the engine and this turning force is transmitted to rotate the rotary shaft of the compressor and to operate the compressor.

In this case, the pulley B and the bearing A are fixed through a bearing sleeve D. FIG. 2 shows a detailed construction of this bearing sleeve D. The bearing sleeve D corresponds to a cylindrical component having a bent portion according to the invention and has a portion D1 protruding inward (corresponding to a bent portion 1*a*) to inhibit movement of the bearing A in the axial direction. To firmly fix the pulley B, the bearing sleeve D has a rotation stop groove D2 (groove 1*b* of cylindrical component 1) that is formed on the outer peripheral surface of the bearing sleeve D.

A cylindrical component having such a bent portion (bearing sleeve) has been produced in the past by pressing a coil material. In this case, a sheet thickness is corrected, and an unnecessary portion is cut off, by pressing in a predetermined shape. Therefore, because scrap occurs, a work for processing the scrap is necessary and the material yield is as low as about 40%. A large number of working steps are necessary, a large investment is necessary for molds and a production preparation period is long.

SUMMARY OF THE INVENTION

In view of the problems described above, the invention aims at providing a method and an apparatus, for producing a cylindrical component, that can mold highly accurately the entire length of the cylindrical component and a planar shape of an end face after processing even when a pipe, that is commercially available and has low sheet thickness accuracy, is used.

It is another object of the invention to accomplish 100% material yield by preventing the occurrence of scrap, to drastically reduce a processing step, to suppress mold costs and to shorten the production preparation period.

In a production method of a cylindrical component having a bent portion according to one aspect of the invention, a preparatory molding roll 4 having a push surface shaped into a convex shape on an outer peripheral surface thereof is advanced and pushed to an outer peripheral surface of a cylindrical work 1A while the work 1A is chucked by a pair of molds 2 and 3 and is rotated by applying axial propelling force, to bend inward the outer peripheral surface of the work 1A in a radial direction and, after the sheet thickness of the work 1A by the preparatory molding roll 4 and the pair of molds 2 and 3 having a dead pocket is clamped, the preparatory molding roll 4 is moved back and the work 1A is crushed in the axial direction in such a manner as to form the bent portion 1*a*. Consequently, the occurrence of the scrap can be prevented, a 100% material yield can be accomplished and the production steps can be drastically reduced in comparison with the press processing of the prior art. The work 1A is chucked and clamped by the preparatory molding roll 4 as the rolling roll and the molds 2 and 3 so that the work material can be concentrated on the dead pocket not requiring accuracy and the entire length of the cylindrical component can be molded highly accurately.

In the production method of the cylindrical component according to the invention, an outer shape molding step of pushing a molding roll 5 to the work 1A and molding an outer shape of the work 1A is added after the crush-molding step. Consequently, the outer shape accuracy of the cylindrical component 1, as the molding, can be improved.

In the production method of the cylindrical component according to the invention, a grooving step of forming a groove 1*b* on the outer peripheral surface of the work 1A by pushing a grooved roll 6 to the work 1A is added after the outer shape molding step. Consequently, a groove 1*b* is formed on the outer peripheral surface of a bearing sleeve as the cylindrical component 1, for example, and a protuberance is formed in the inner peripheral surface of a pulley as a counterpart member so that the bearing sleeve and the pulley can be firmly fixed to each other through concavo-convex fitting.

In the production method of the cylindrical component according to the invention, three rolls, that is, the preparatory molding roll 4, the molding roll 5 and the grooved roll 6, are arranged around the work 1A in such a manner as to be capable of moving towards and away from the work 1A. Consequently, molding at one rolling step can be done using three kinds of rolls.

A production apparatus of a cylindrical component having a bent portion according to the invention, using the production method of the cylindrical component having a bent portion as described above, includes a pair of spindles 7 and 9 for holding the work 1A, rotating the work 1A while pushing the work 1A in an axial direction; and retractile means 12 for moving the roll 4 towards and away from the work 1A in a radial direction. The function and effect is the same as that of the production method described above.

The present invention may be more fully understood from the description of preferred embodiments of the invention, as set forth below, together with the accompanying drawings.

DESCRIPTION OF THE PREFERRED EMBODIMENTS

Figure 6:
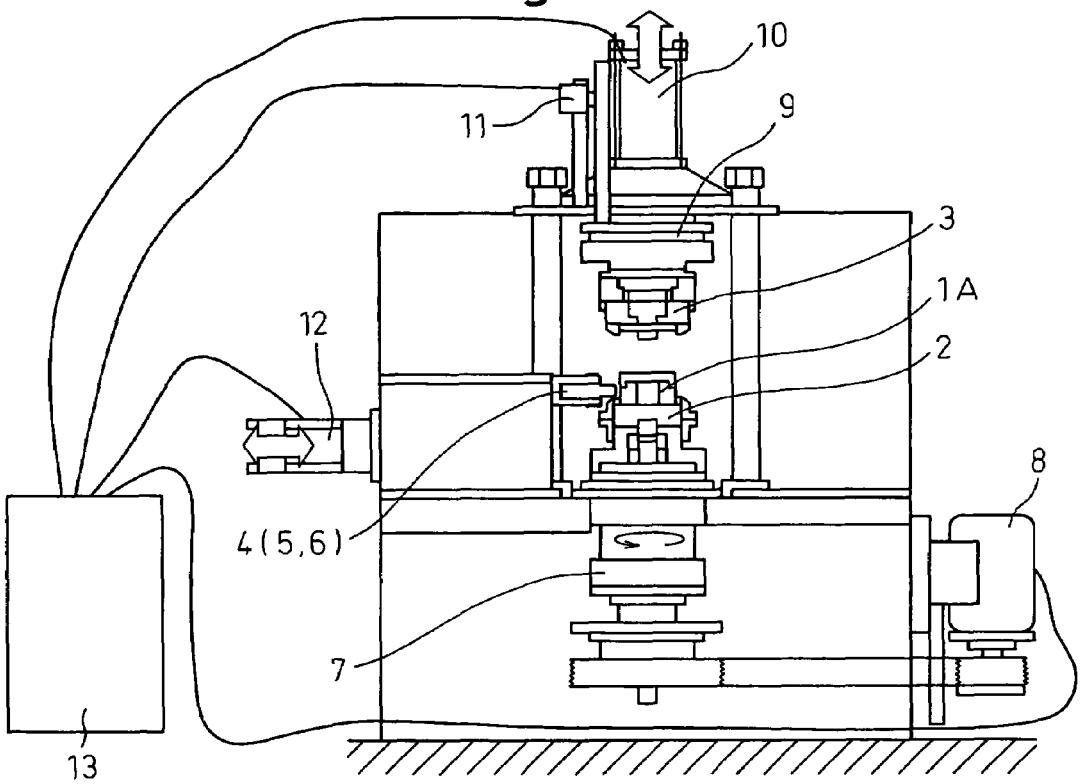
FIG. 6 shows an overall construction of a production apparatus (roll grinder) for carrying out the production method according to the embodiment of the invention.
Figure 7:
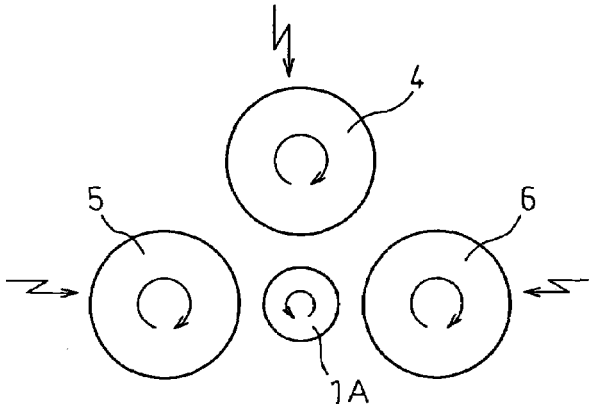
FIG. 7 is an arrangement view of three rolling rolls.

A production method of a cylindrical component having a bent portion according to an embodiment of the invention will be explained with reference to the drawings. First, a production apparatus (rolling grinder) for executing the production method of the cylindrical component according to the invention will be explained. FIG. 6 shows an overall construction of the production apparatus and FIG. 7 shows an arrangement view of rolling rolls. A spindle 7 (main driving side means) for rotatably supporting a lower mold 2 of a mold is provided to a base of the production apparatus and is driven for rotation by a motor 8 through a belt 14.

A loose head stock (follower side means) 9 is rotatably fitted to a hydraulic cylinder 10 above the spindle 7. Therefore, the loose head stock 9 is moved up and down by the hydraulic cylinder 10. The upper mold 3 of the mold is fitted to the loose head stock 9. When a work 1A is molded, the work 1A is clamped by the upper mold 3 and the lower mold 2. In consequence, the rotation of the spindle 7 by the motor 8 is transmitted during molding to the loose head stock 9 through the lower mold 2, the work 1A and the upper mold 3 and the loose head stock 9 integrally rotates. In other words, the spindle 7 is on the main driving side and the loose head stock 9 is on the follower side. Incidentally, the upper mold 3 and the lower mold 2 together constitute the mold.

A loose head stock position sensor 11 is provided to the loose head stock 9 and position information of the loose head stock 9, that is, the position information of the upper mold 3, is sent to a control panel 13. The control panel 13 drives the hydraulic cylinder 10 on the basis of this position information and moves the loose head stock 9 (upper mold 3) up and down.

Three rolls, that is, a preparatory molding roll 4, a molding roll 5 and a grooved roll 6, are arranged as rolling rolls around the lower mold 2 on the base, that is, around the work 1A held by the lower mold 2, in such a manner as to be retractile as shown in FIG. 7. Incidentally, FIG. 6 shows only one roll. These three rolling rolls 4, 5 and 6 are retracted by respective hydraulic cylinders (retractile means) 12 between a position where they keep contact with the work 1A and a position at which they are separated from the work 1A. When coming into contact with the work 1A rotated by the spindle 7, these three rolling rolls 4, 5 and 6 are relatively rotated. The retraction of the rolling rolls 4, 5 and 6 by the hydraulic cylinder 12 is materialized on the basis of the instruction from the control panel 13. Similarly, driving of the motor 8 is made on the basis of the instruction from the control panel 13.

Figure 8A:
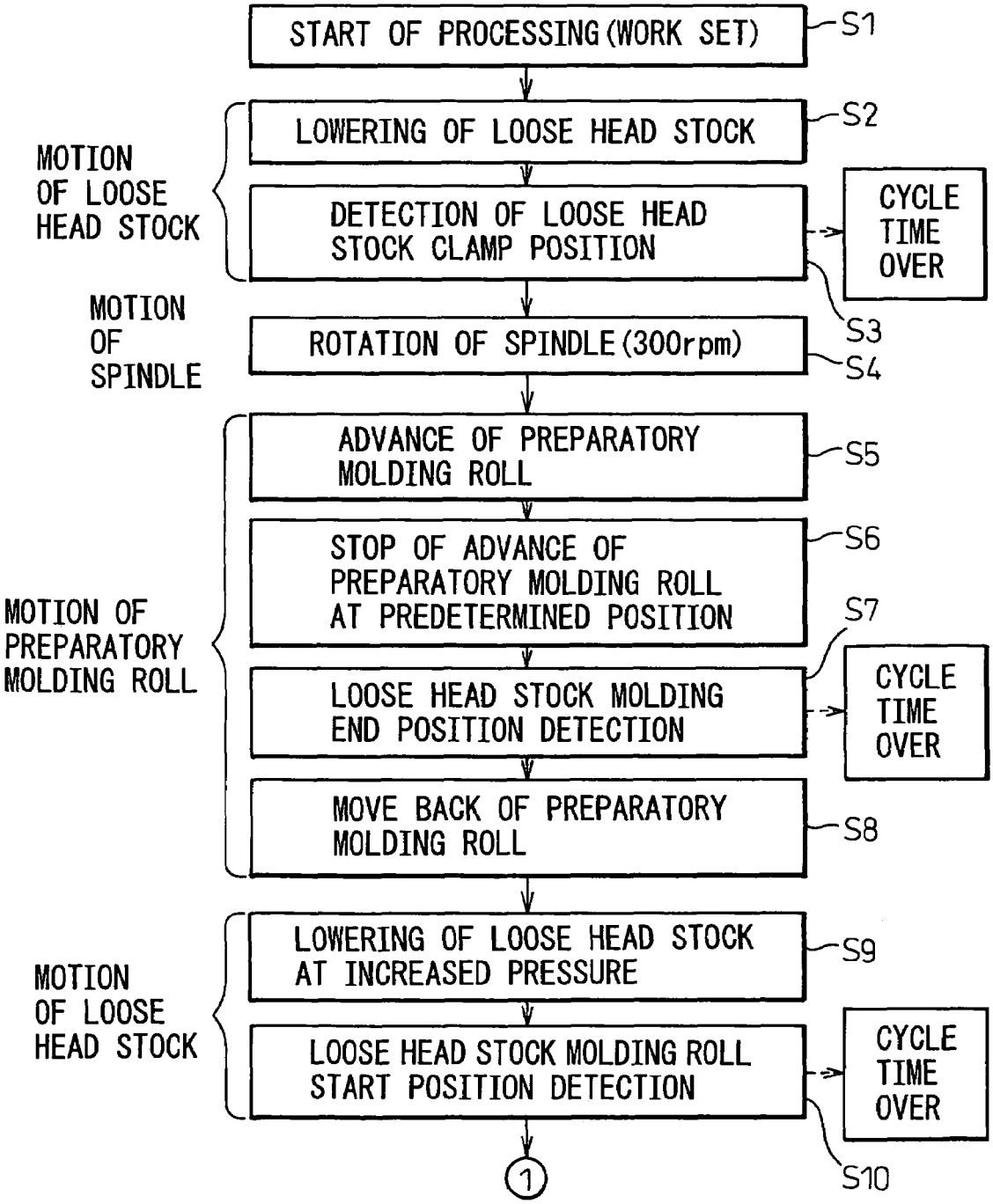
FIGS. 8A and 8B are a flowchart for explaining the operation of the production apparatus according to the invention.
Figure 8B:
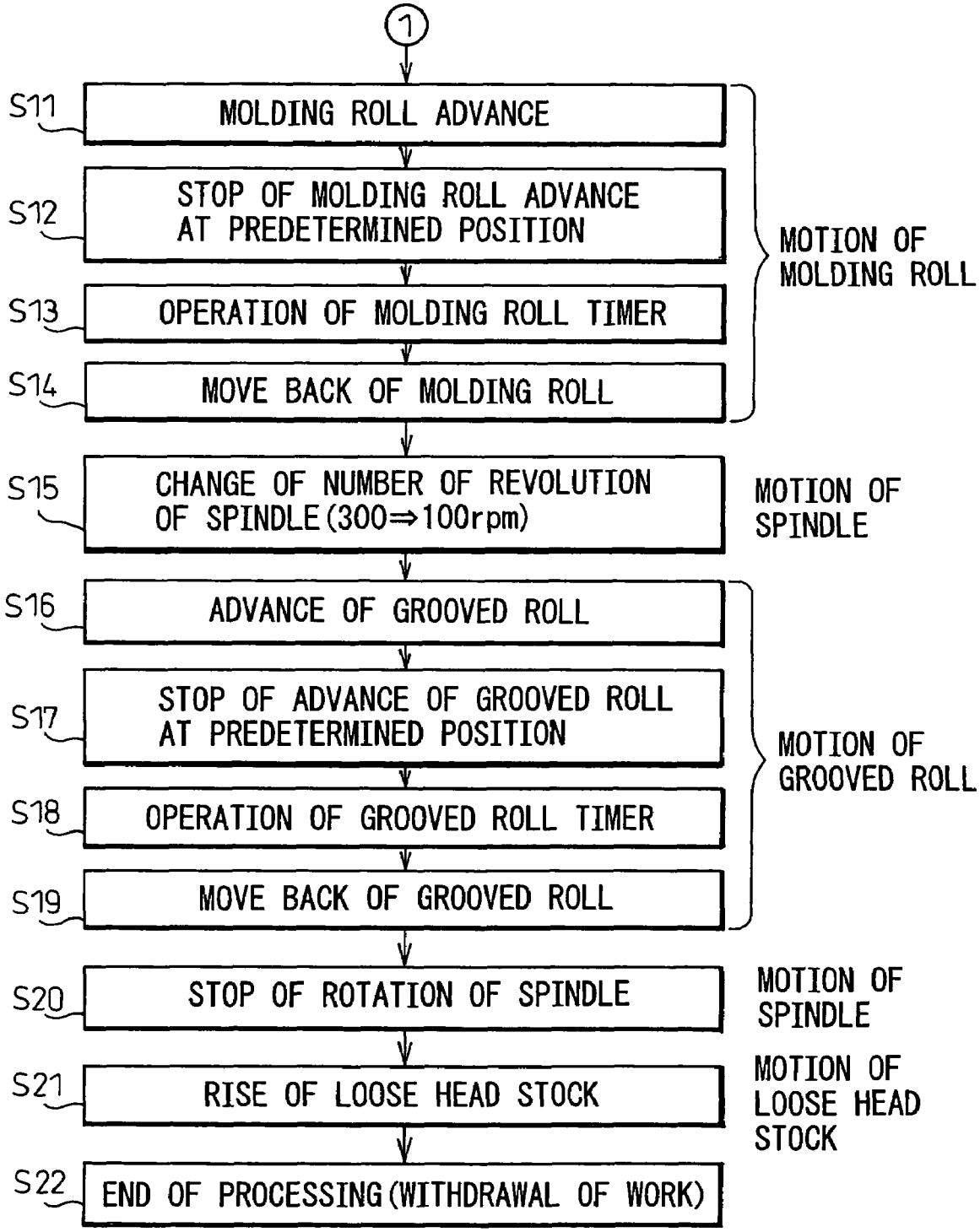

The operation of the apparatus having the construction described above is executed in accordance with the flowchart shown in FIGS. 8A and 8B. First of all, the work 1A is set to the lower mold 2 fixed to the spindle 7 (Step S1). Incidentally, the work 1A is prepared by cutting a pipe member, that is commercially available, into a predetermined length. Next, the hydraulic cylinder 10 is operated and the loose head stock 9 is lowered in such a manner as to clamp the work 1A between upper mold 3 fitted to the loose head stock 9 and the lower mold 2 fixed to the spindle 7 (Step S2). In the subsequent Step S3, the position of the work 1A clamped by the loose head stock 9 is detected by the loose head stock position sensor 11 and after clamp of the work 1A is completed, the cycle time of the hydraulic cylinder 10 is finished and descent of the loose head stock 9 stops temporarily. These Steps S2 and S3 represent the clamp operation of the loose head stock 9.

Next, the spindle 7 is driven and rotated by the motor 8 at a rotating speed of about 300 rpm (Step S4). The hydraulic cylinder 12 is then driven and the preparatory molding roll 4 is allowed to advance (Step S5) so that the preparatory molding roll 4 comes into contact with the outer peripheral surface of the work 1A and pushes this outer peripheral surface. When the preparatory molding roll 4 advances further from the contact position, the outer peripheral surface of the work 1A is gradually bent inward as shown in FIG. 4B. Molding by this preparatory molding roll 4 will be explained later in further detail with reference to FIGS. 4A to 4C. When the preparatory molding roll 4 advances to a predetermined position, the operation of the hydraulic cylinder 12 is stopped and the advance of the preparatory molding roll 4 is stopped (Step S6).

When the bent portion 1*a* of the work 1A is molded by the preparatory molding roll 4, the length of the work 1A in the axial direction becomes small and the work 1A cannot be pushed and clamped by the upper mold 3 and the lower mold 2. To prevent this problem, the hydraulic cylinder 10 operates during bend-molding by the preparatory molding roll 4 and the loose head stock 9 moves down. When preparatory molding by the preparatory molding roll 4 is finished and the loose head stock position sensor 11 detects the arrival of the loose head stock 9 at the preparatory molding end position (Step S7), the cycle time of the hydraulic cylinder 10 is finished and the descent of the loose head stock 9 temporarily stops. Next, the hydraulic cylinder 12 operates so that the preparatory molding roll 4 moves back and is separated from the work 1A (Step S8). Steps S5 to S8 represent the motion of the preparatory molding roll 4.

Figure 5:
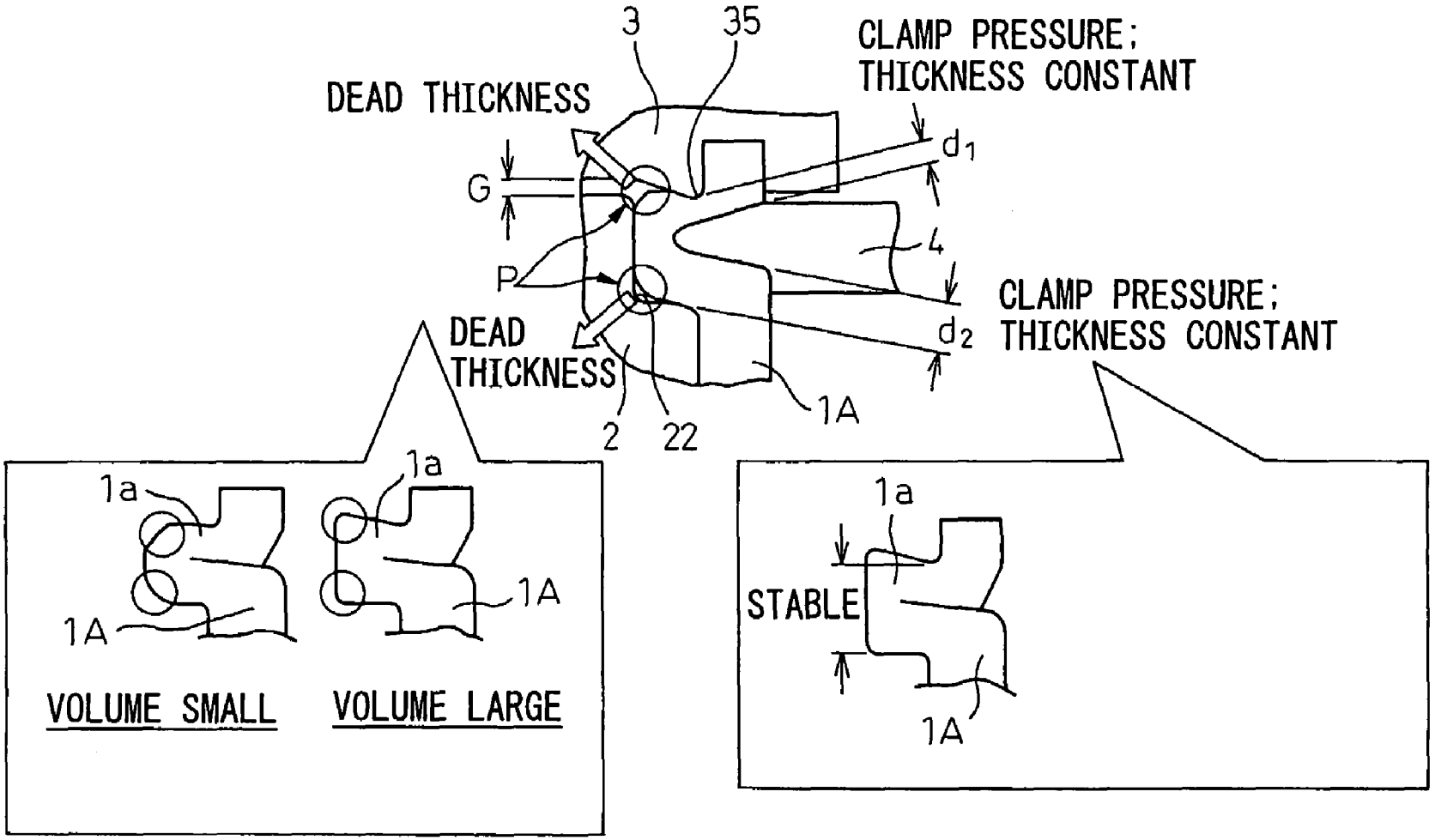
FIG. 5 is a detailed view at the time of completion of molding by the preparatory molding roll.

After the preparatory molding roll 4 moves completely back, the oil pressure of the hydraulic cylinder 10 is increased and the loose head stock 9 is lowered at an increased pressure (Step S9). Consequently, the bent portion of the work 1A formed by the preparatory molding roll 4 is crushed and a bent portion 1*b* at which the sheet thickness is completely superposed as shown in FIG. 5 is formed. This crushing step of Step S9 will be explained later in further detail with reference to FIG. 5. The finish of the crushing step is detected by the position of the loose head stock 9. Consequently, the hydraulic cylinder 10 finishes its cycle time, lowering at the increased pressure stops and the upper mold 3 and the lower mold 2 clamp the work 1A under the normal push-clamp state. In other words, the start position of the molding roll 5 is detected (Step S10).

In Step S11, the hydraulic cylinder 10 operates and the molding roll 5 moves forth. The molding roll 5 moves forth, comes into contact with the outer peripheral surface of the work 1A and stops at a predetermined position (Step S12). Next, the timer of the molding roll 5 is operated (Step S13) and the molding roll 5 is pushed to the outer peripheral surface of the work 1A that is rotating to mold the outer peripheral surface of the work 1A. After molding of the outer shape by the molding roll 5 is carried out for a predetermined time, the molding roll 5 moves back and separates from the work 1A (Step S14). Steps S10 to S14 described above represent the motion of the molding roll 5.

After the molding roll 5 moves back, the number of revolutions of the spindle 7 is changed from about 300 rpm to about 100 rpm (Step S15).

Next, the hydraulic cylinder 12 is operated and the grooved roller 6 is moved forth (Step S16), is allowed to come into contact with the outer peripheral surface of the work 1A and is stopped at a predetermined position at which the roll 6 pushes the work 1A (Step S17). Here, the timer of the grooved roll 6 is operated (Step S18) and grooving of the outer peripheral surface of the work 1A by the grooved roll 6 is carried out for a predetermined time. After grooving is completed, the grooved roller 6 moves back and separates from the work 1A (Step S19). Steps S15 to S19 represent the motion of the grooved roll 6.

After the grooved roll 6 moves back, the operation of the motor 8 is stopped and the rotation of the spindle 7 is stopped (Step S20). Next, the hydraulic cylinder 10 is operated to raise the loose head stock 9 and the push-clamping of the work 1A by the upper mold 3 and the lower mold 2 is released (Step S21). Finally, the work 1A, after the finish of processing, is withdrawn (Step S22). The work 1A is shaped and processed in this way into the cylindrical component 1 having the bent portion 1*a*.

Figure 3:
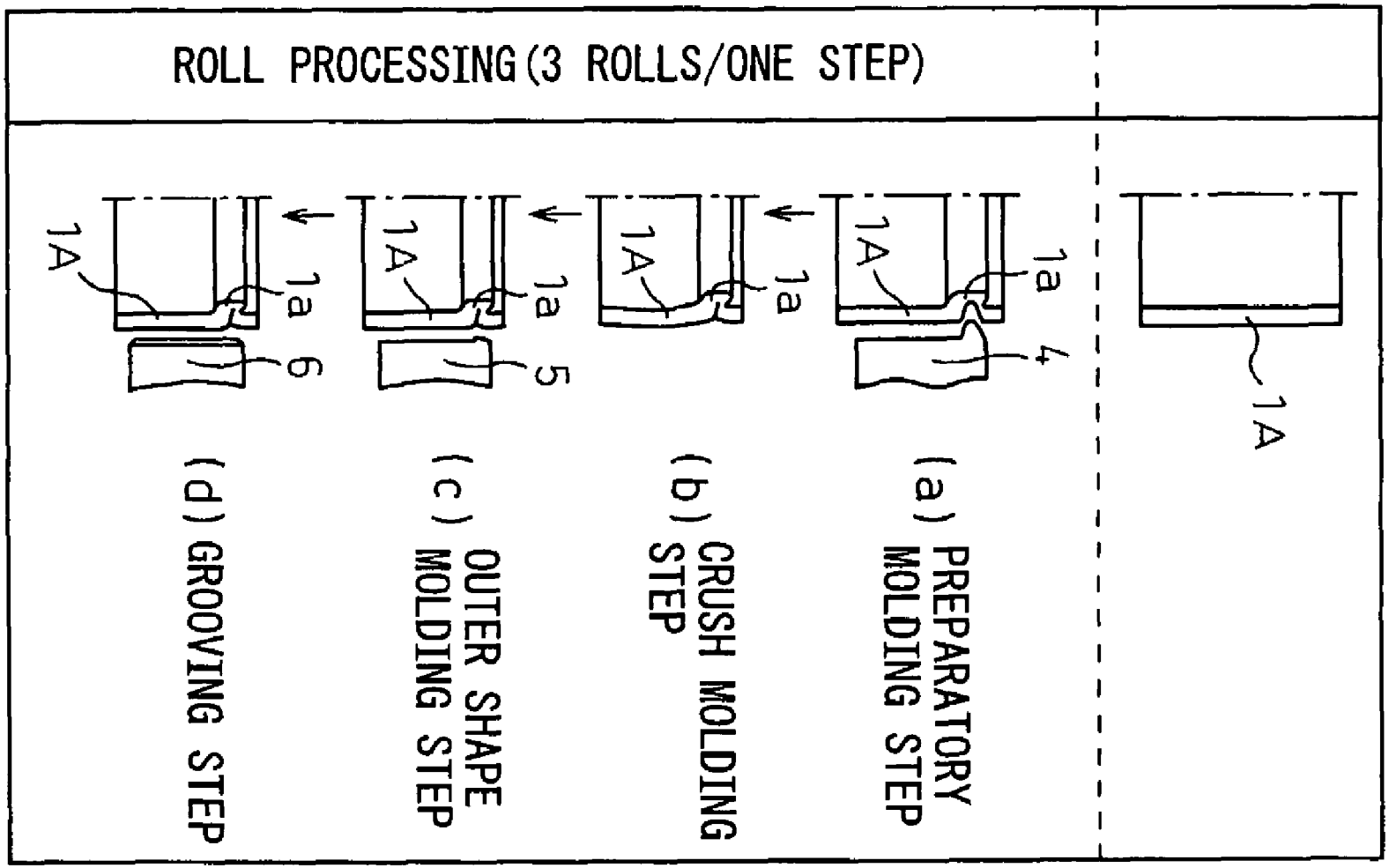
FIG. 3 is an explanatory view for explaining processing steps (a) to (d) of a production method of a cylindrical component having a bent portion according to an embodiment of the invention.

Next, the operation as the most characterizing feature of this embodiment will be explained with reference to FIGS. 3, 4A to 4C and 5. FIG. 3 explains the roll processing steps by the three rolling rolls 4, 5 and 6. For example, the work 1A, as a cylindrical blank prepared by cutting a commercially available pipe member into a predetermined length, is held by the mold of the upper and lower molds 2 and 3 as described above and is rotated by the spindle 7 as the axial propelling force is applied. In the preparatory molding step shown in FIG. 3(*a*), the operations of Steps S5 to S8 described above are carried out. In other words, the convex push surface of the preparatory molding roll 4 is pushed to the outer peripheral surface of the work 1A to bend inward the outer peripheral surface of the work 1A in the radial direction.

In the crush molding step shown in FIG. 3(*b*), the operations of Steps S9 and S10 described above are carried out. In other words, after the preparatory molding roll 4 moves away from the work 1A, the loose head stock 9 lowers at the increased pressure. Consequently, the work 1A clamped between the upper mold 3 and the lower mold 2 receives the compressive force that is increased in the axial direction and the bent portion 1*a* shaped by the preparatory molding roll 4 is crushed into the superposed state shown in FIG. 3(*b*). Lowering of the loose head stock 9 at the increased pressure is completed when the bent portion 1*a* is crushed and the sensor 11 detects the position of the loose head stock 9 in the stable state of the bent thickness. The advancing of the next molding roll 5 starts.

As the outer peripheral surface of the work 1A is under the free condition and is not supported from outside during the crush molding step described above, as shown in FIG. 3(*b*), a side surface of the work 1A is curved to some extent. Therefore, the operations of Steps S11 to S14 described above are carried out in the outer shape molding step shown in FIG. 3(*c*). The molding roll 5 is pushed to the outer peripheral surface of the work 1A to shape it and the side surface of the work 1A is corrected to the straight state.

Figure 1:
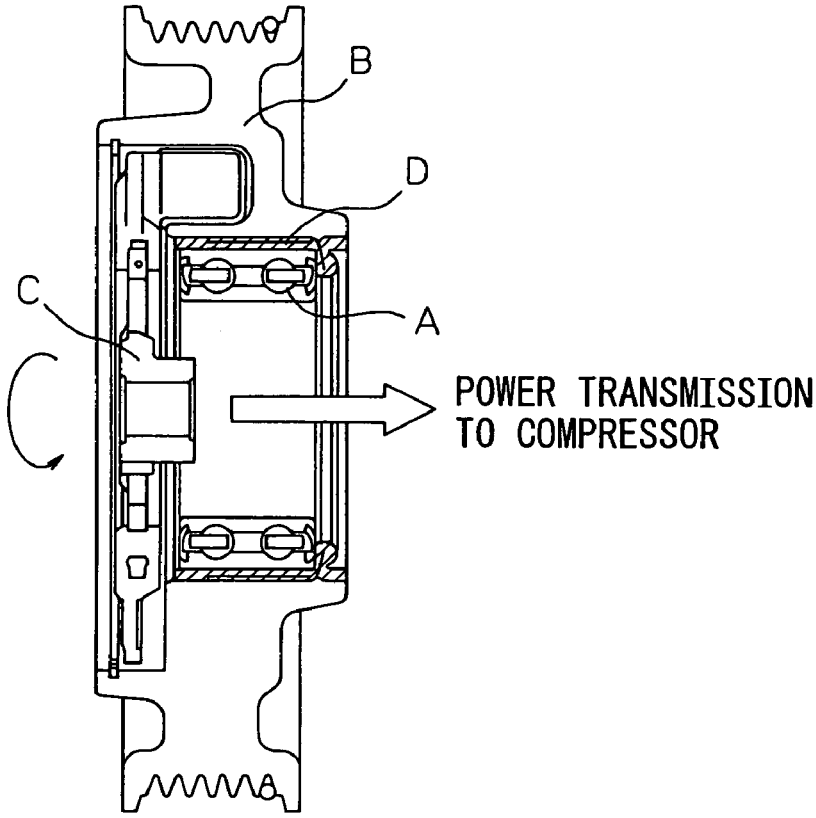
FIG. 1 shows an example of the use of a cylindrical component molded by a production method according to an embodiment of the invention.
Figure 2:
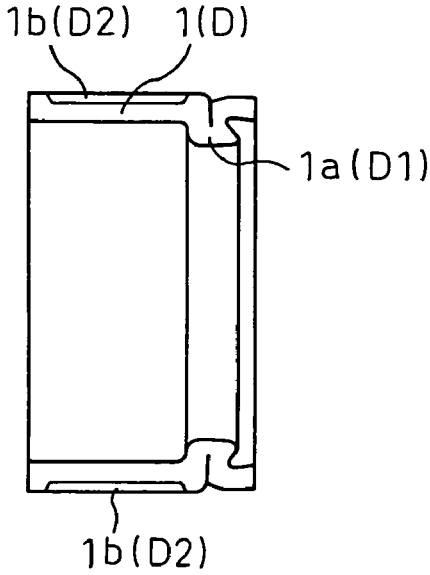
FIG. 2 is an enlarged view of a bearing sleeve as a cylindrical component.

FIG. 3(*d*) shows the grooving step in which the Steps S16 to S19 described above are carried out. In this grooving step, the grooved roll 6 is pushed to the outer peripheral surface of the work 1A and the groove 1*b* is formed on the outer peripheral surface of the work 1A. This groove 1*b* is formed to improve fixation of the cylindrical component 1 as the molding to other component such as the bearing sleeve D and the pulley B shown in FIG. 1, for example, and this step may be omitted when grooving is not necessary.

Figure 4A:
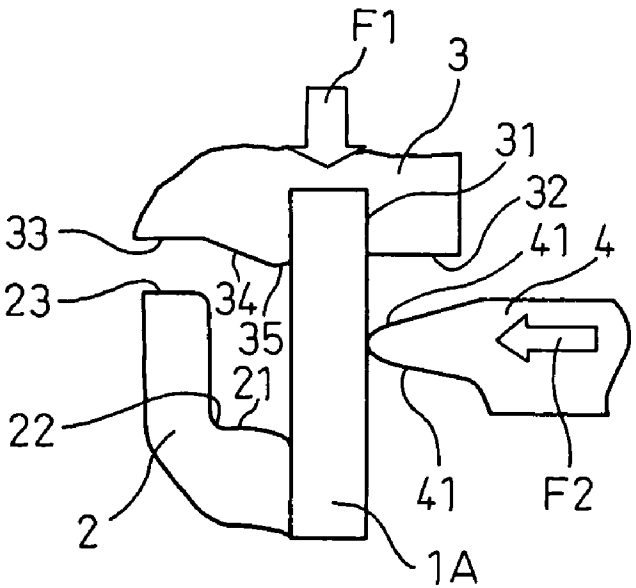
FIGS. 4A to 4C are explanatory views for explaining shaping processes, by a preparatory molding roll, in the production method according to the embodiment of the invention.
Figure 4B:
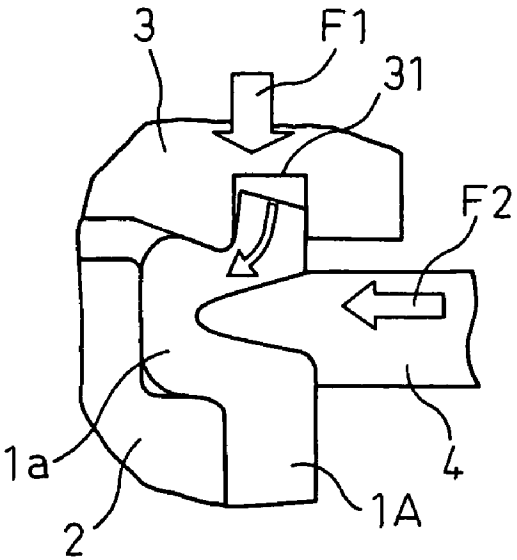
Figure 4C:
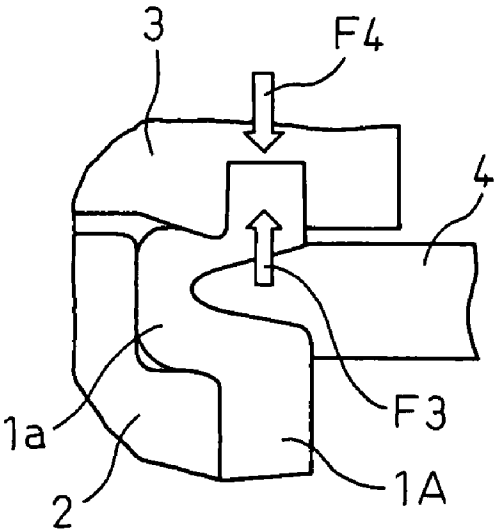

FIGS. 4A to 4C explain the molding process of the bent portion by the preparatory molding roll 4. A ring-like step portion 21 is formed on the lower mold 2 to settle the bent portion 1*a* of the work 1A and a corner 22 of this step portion 21 is a dead pocket P. A ring-like recess 31 for accommodating the end portion of the work 1A is formed on the lower surface of the upper mold 3. The lower surface 32 on the outer side is somewhat lower than the lower surface 33 on the inner side with this recess 31 being the boundary as shown in FIG. 4. Therefore, a slope 34 is formed so as to extend from the recess 31 to the lower surface 33 on the inner side and the inner edge of the recess 31 forms an edge 35.

On the other hand, a convex push surface 41 having a substantially triangle-shaped section is disposed on the preparatory molding roll 4.

In FIG. 4A, the work 1A is pushed and clamped by the upper mold 3 and the lower mold 2 and the upper end portion of the work 1A is accommodated in the recess 31 of the upper mold 3. The push force F1 in the axial direction is applied under this state to the work 1A from the hydraulic cylinder 10. As the preparatory molding roll 4 advances, its push surface 41 comes into contact with the outside surface of the work 1A and the preparatory molding roll 4 applies the push force F2 in the radial direction to the work 1A by the hydraulic cylinder 12.

Accordingly, the side surface of the work 1A is gradually bent inward as shown in FIG. 4B. The upper mold 3 gradually lowers with the bending operation and the preparatory molding roll 4 further advances. Owing to this bending operation, the upper end surface of the work 1A tilts from the horizontal condition and leaves the bottom surface of the recess 31. Finally, the push-up force F3 from the push surface 41 of the preparatory molding roll 4 and the lowering force F4 of the upper mold 4 balance each other, so that the upper end portion of the work 1A is fully accommodated inside the recess 31 of the upper mold 3 and the upper end surface of the work 1A is corrected to the horizontal condition.

FIG. 5 explains the condition where molding of the bent portion by the preparatory molding roll 4 is complete. As shown in FIG. 5, the lowering position of the upper mold 3 at the time of completion of molding by the preparatory molding roll 4 is the position at which a predetermined gap G is formed between the upper surface 23 of the lower mold 2 and the inner lower surface 33 of the upper mold 3. This gap G and the corner 22 of the step portion 21 in the lower mold 2 play the role of the dead pocket P for absorbing the volume change (dead thickness) occurring at the bent portion during bending. Gaps $d_1$ and $d_2$ are formed between the edge 35 on the inner edge of the recess 31 of the upper mold 3 and the push surface 41 of the preparatory molding roll 4 and between the step portion 21 of the lower mold 2 and the push surface 41 of the preparatory molding roll 4 at the time of completion of molding, respectively, and these gaps $d_1$ and $d_2$ secure the thickness of the bent portion 1*a*.

After molding of the bent portion by the preparatory molding roll 4 is complete, the preparatory molding roll 4 moves back as described already, the upper mold 3 is further lowered and the bent portion 1*a* of the work 1A is crushed in the axial direction so that the bent portions 1*a* completely superpose with one another. When the volume change of the bent portion 1*a* is small as shown in FIG. 5, a bent corner 1*c* having a large bending radius is formed in this case on the outer peripheral surface of the bent portion 1*a*. When the volume change is great, a bent corner 1*d* having a small bending radius is formed. The thickness of the bent portion 1*a* can be stably formed to a thickness of about $d_1+d_2$ and the entire length of the cylindrical component 1 as the molding of the work 1A can be shaped accurately.

As explained above, according to the invention, the material is clamped by the rolling rolls and the mold (upper and lower molds) and is allowed to concentrate at the dead spot P not requiring accuracy, so that accuracy of the entire length of the molding and the planar shape of the end face can be shaped highly accurately. The invention makes it possible to conduct molding in one rolling step (3 rolls) and to drastically reduce the molding step. Because only the rolling step is necessary, the scrap of the material does not occur and 100% of the material yield can be accomplished. Furthermore, the investment of the mold and production preparation period can be reduced. Though FIG. 6 shows the longitudinal type production setup (rolling disk) by way of example, a horizontal type production apparatus (rolling disk) may be used, too. In addition, the spindle 7 is on the main driving side and the loose head stock 9 is on the follower side. However, it is also possible to drive the loose head stock 9 by the motor and to rotate it simultaneously with the spindle 7.

While the invention has been described by reference to the specific embodiments chosen for purposes of illustration, it should be apparent that numerous modifications could be made thereto by those skilled in the art without departing from the basic concept and scope of the invention.

The invention claimed is:

1. A production method of a cylindrical component having a bent portion through rolling by pushing rolls to a cylindrical work obtained from a pipe material, comprising:

a clamping step of clamping a cylindrical work with a pair of molds, an end portion of the work being accommodated in a ring-like recess in a first of the pair of molds, wherein a projection is provided on an inner edge of the ring-like recess and a slope is formed from the projection to an internal circumference of the first of the pair of molds so as to increase a distance from the second of the pair of molds, the second of the pair of molds having an inserting portion arranged inside the work;

a preparatory molding step of advancing a preparatory molding roll having a push surface shaped into a convex shape on an outer peripheral surface thereof and pushing it to an outer peripheral surface of the work so that the prepatory molding roll is located below the projection and the work is sandwiched between the molding roll and the projection while said work is chucked by the pair of molds and is rotated by applying axial propelling force, to bend inward the outer peripheral surface of said work in a radial direction, a ring-like step portion being formed on a tip of the inserting portion to define a bent portion of the work; and a crush-molding step of clamping the sheet thickness of said work by said preparatory molding roll and said pair of molds, a gap between the slope and the second of the pair of molds, and a space on a corner of the step portion, being dead pockets, then moving back said preparatory molding roll and crushing said work in the axial direction to form the bent portion.

2. A production method of a cylindrical component having a bent portion as defined in claim 1, which further comprises an outer shape molding step of molding an outer shape of said work by pushing molding rolls to said work after said crush-molding step.

3. A production method of a cylindrical component having a bent portion as defined in claim 2, which further comprises a grooving step of forming a groove on an outer peripheral surface of said work by pushing a grooved roll to said work after said outer shape molding step.

4. A production method of a cylindrical component having a bent portion as defined in claim 3, wherein three rolls, that is, said preparatory molding roll, said molding roll and said grooved roll, are arranged around said work in such a manner as to be capable of moving towards and away from said work.

5. A production method of a cylindrical component having a bent portion as defined in claim 3, further comprising decreasing the number of the revolutions of the work before a grooving step after an outer shape molding step.

6. A production method of a cylindrical component having a bent portion as defined in claim 5, wherein the decreasing the number of revolutions decreases the revolutions from about 300 rpm to about 100 rpm.

7. A production apparatus for producing a cylindrical component having a bent portion by using said production method of a cylindrical component having a bent portion as defined in claim 1 by pushing a roll to a cylindrical work and producing a cylindrical component having a bent portion by roll processing, comprising:

a pair of molds that clamp the cylindrical work, a first of the pair of molds comprising a ring-like recess, a projection on an inner edge of the ring-like recess, and a slope from the projection to an internal circumference of the first of the pair of molds so as to increase a distance from a second of the pair of molds, the second of the pair of molds comprising an inserting portion, arranged inside of the work, with a ring-like step portion on a tip of the inserting portion;

a pair of spindles for holding said work, rotating said work while pushing said work in an axial direction; and retractile means for moving said roll towards and away from said work in a radial direction.

8. A production method of a cylindrical component having a bent portion as defined in claim 1, further comprising:

detecting a driving position of a cylinder used to move one of the pair of molds toward the other of the pair of molds; and controlling the drive of the cylinder to perform a process of crushing the work in the axial direction to form the bent portion after moving back the molding roll when one of the pair of molds reaches a first predetermined position.

9. A production method of a cylindrical component having a bent portion as defined in claim 8, wherein the process of crushing the work in the axial direction to form the bent portion is finished when one of the pair of molds reaches a second predetermined position.

* * * * *